US006939419B1

(12) United States Patent
Utyashev et al.

(10) Patent No.: US 6,939,419 B1
(45) Date of Patent: Sep. 6, 2005

(54) METHOD FOR PRODUCING AXIALLY SYMMETRIC PARTS AND THE ARTICLE

(75) Inventors: Farid Zainullaevich Utyashev, Ufa (RU); Oscar Akramovich Kaibyshev, Ufa (RU); Vener Anvarovich Valitov, Bashkortostan (RU)

(73) Assignees: General Electric Company, Schenectady, NY (US); Institute of Metals Superplascity Problems of Academy of Science, Ufa (RU)

( * ) Notice: Subject to any disclaimer, the term of this patent is extended or adjusted under 35 U.S.C. 154(b) by 0 days.

(21) Appl. No.: 09/194,664

(22) PCT Filed: Jun. 19, 1997

(86) PCT No.: PCT/US97/10673

§ 371 (c)(1),
(2), (4) Date: Feb. 14, 2002

(87) PCT Pub. No.: WO97/48509

PCT Pub. Date: Dec. 24, 1997

(30) Foreign Application Priority Data

Jun. 21, 1996 (RU) ..... 96112649

(51) Int. Cl.[7] ..... C22F 1/10

(52) U.S. Cl. ..... 148/675; 148/669; 148/670; 148/671; 148/609; 148/621; 148/624; 148/648

(58) Field of Search ..... 72/67, 69, 77, 72/78, 82, 84, 83, 95, 98, 100, 112, 302, 342.94, 342.96, 364, 377, 378; 148/669, 670, 671, 675, 609, 621, 624, 648

(56) References Cited

U.S. PATENT DOCUMENTS 3,519,503 A 7/1970 Moore et al.
4,617,817 A * 10/1986 Gegel et al. ..... 72/364
6,565,683 B1 * 5/2003 Utyashev et al. ..... 148/624
6,589,371 B1 * 7/2003 Kaibyshev et al. ..... 148/504
6,826,940 B2 * 12/2004 Utyashev et al. ..... 72/100

FOREIGN PATENT DOCUMENTS

| | | |
|---|---|---|
| JP | 3-236452 | 10/1991 |
| RU | 2022710 | 11/1994 |
| SU | 470346 | 5/1975 |
| SU | 727287 | 4/1980 |
| SU | 1442310 | 12/1988 |
| SU | 1770014 | 10/1992 |

OTHER PUBLICATIONS

Koppers, U: "Flexibles Walzen Von Ringen Mit Profilquerschnitt–Anwendungen" Umformtechnik, vol 27, No. 1, pp. 35–38, (1993).
Translation of USSR Inventor's Certificate 470346, May 15, 1975.

* cited by examiner

*Primary Examiner*—John P. Sheehan
(74) *Attorney, Agent, or Firm*—Jay L. Chaskin; Cantor Colburn LLP

(57) ABSTRACT

The invention relates to plastic metal working, more specifically to methods for producing parts of the disk- or shell-type having conical, hemispherical, and also combined parts, such as disk-and-shaft ones. The invention is instrumental in producing large axially symmetric parts from hard-to-work multiphase alloys. The method consists in that the billet is heated in a temperature range above 0.4 m.p. but below the temperature at which a total content of precipitates or an allotropic modification of the matrix of a multiphase alloy is not below 7%. Then the preheated billet is rolled, while controlling its temperature and the tool load, as well as the rolling speed. Once rolled the billet is heat-treated at a temperature depending on the microstructure of the billet material resulting from rolling. Prerolling preparing of a specified microstructure of the billet material is also described.

24 Claims, 11 Drawing Sheets

FIG.6A
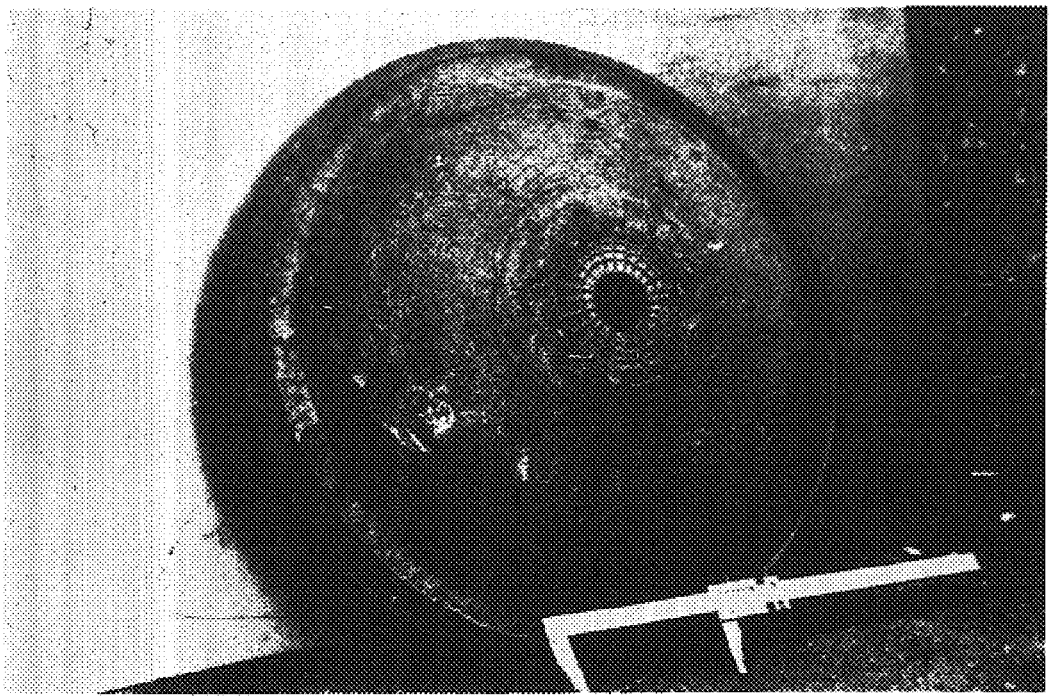
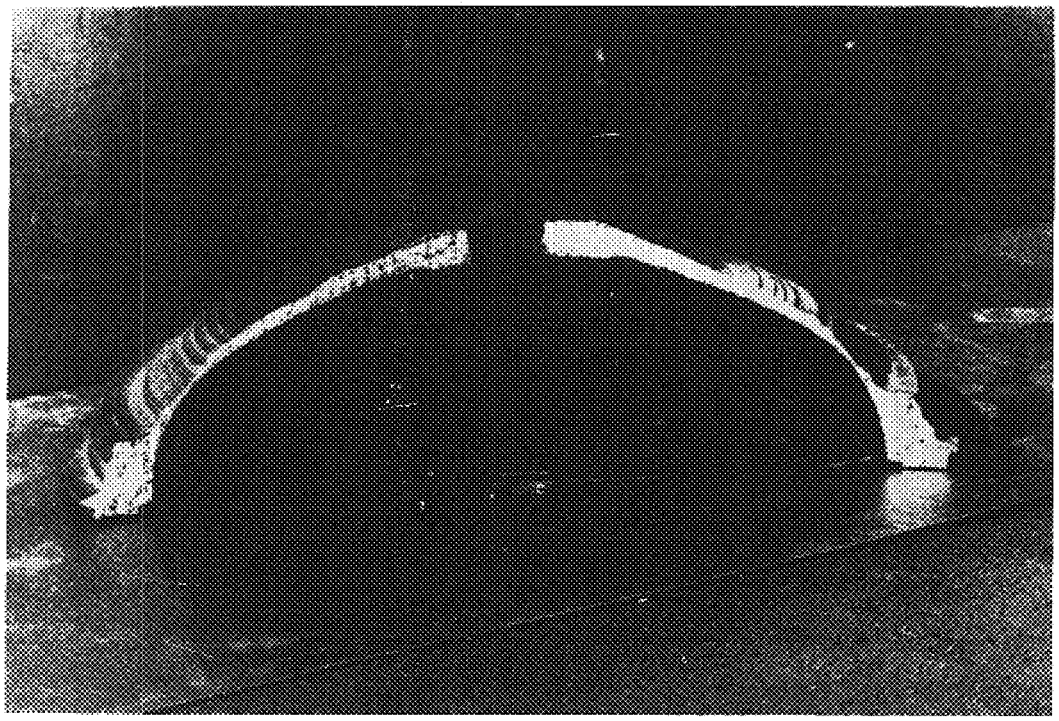
FIG.6B

FIG.11A
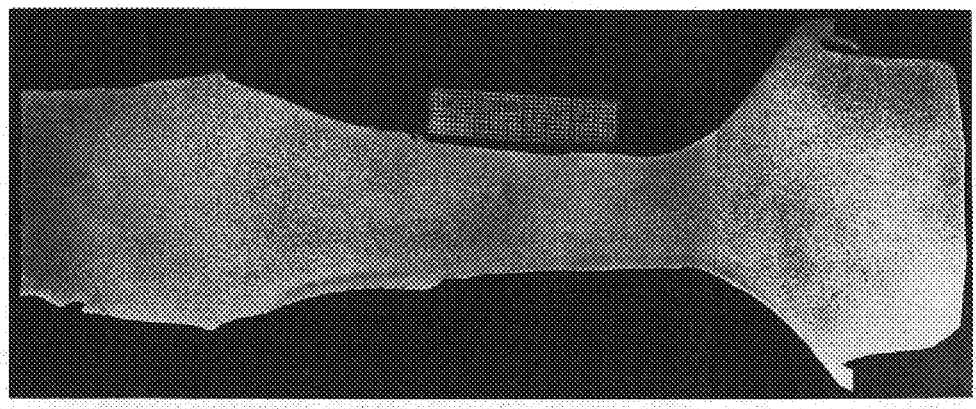
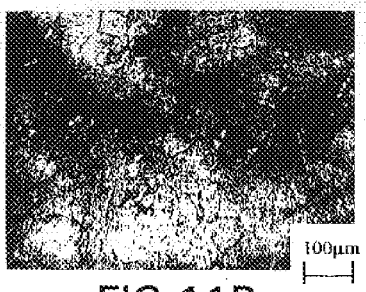
FIG.11B
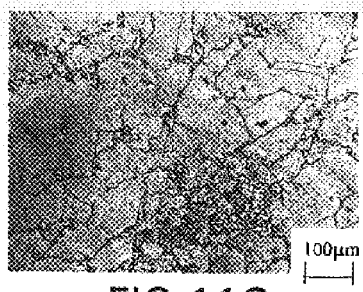
FIG.11C
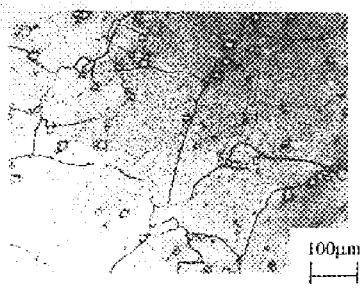
FIG.11D

METHOD FOR PRODUCING AXIALLY SYMMETRIC PARTS AND THE ARTICLE

FIELD OF THE INVENTION

The present invention relates in general to plastic metal working and more specifically, to methods for producing precise billets for the disk-type parts having conical, hemispherical, and other axially symmetric shapes.

BACKGROUND OF THE INVENTION

Large axially symmetric parts are reasonably produced by local forming processes, such as rolling. Used as a tool in this case are rolls featured by broad versatility, substantially smaller size and a simpler shape as compared to forming dies. Moreover, rolling equipment is much superior to die-forging presses and hammers used for producing parts of similar size, as to specific metal content and power consumption.

One prior-art method for producing axially symmetric parts of the disk type having a hub and a web (cf. USSR Inventor's Certificate # 470,346, 1975, IPC B21K 1/32) is known to comprise preparing a billet by the upsetting procedure, followed by producing the desired part from said billet by spreading, hot pressing, rolling, sizing, and heat-treatment. The method in question is practicable only for making such parts as disks for wheels of railway stock from conventional multiphase carbon when subjected to hot forming within a wide temperature range. However, constructions of power plants, modem aerospace engineering, and other technology make extensive use of nickel-, titanium-, and iron-base multiphase high alloys. Such alloys are featured by high temperature strength and resistance to gas corrosion but are poorly processed due to low plasticity and high strain resistance. This in turn involves high labor-, power-, and material consumption for producing parts from said alloys using metal-working techniques. Therefore by using the techniques disclosed in said known method, one cannot produce axially symmetric parts, such as disks of gas-turbine engines and parts having elliptical, conical, or hemispherical surfaces from nickel-, iron, or titanium-base hard-to-work multiphase high-temperature alloys.

Used for producing parts from the aforementioned alloys is, e.g., a method known as Gatorizing™ (U.S. Pat. No. 3,519,503, 1970, IPC C22F 1/10). The production process, according to said method, includes preparing a billet having a fine-grained microstructure, forging in the state of superplasticity, followed by finish heat-treatment. The method makes possible producing small intricately shaped forged blanks with a minimized level of tolerance. However, the method is inefficient, due to a necessity for using power-consuming metal-working machinery and large amounts of expensive forging tools, for producing large intricate-configuration parts, especially those from nickel-base superalloys.

Thus, producing large axially symmetric parts from high-temperature low alloys is now an urgent problem.

In addition, it should be noted that parts made of high-temperature alloys, e.g., integral rotors (bladed disks), or disks of gas-turbine engines, are to operate under complicated working conditions. That is why it is expedient that special inhomogeneous states of microstructure be established in the various zones of such parts so as to provide an optimum set of properties meeting the actual working conditions of such parts. However, an adequately high level of properties indispensable for modern power plants cannot be attained by the heretofore-known methods.

SUMMARY OF THE INVENTION

It is a principal object of the present invention to provide a method for producing large axially symmetric parts from hard-to-work multiphase alloys.

It is another object of the present invention to reduce labor consumption and increase material utilization factor when producing axially symmetrical parts.

It is a further object of the present invention to establish such a specified microstructure of the material of the parts being produced that is either homogeneous or cross-sectionally variable in a special manner, thus imparting an optimum set of performance characteristics to the part produced.

The foregoing objects are accomplished due to the provision of a method for producing axially symmetric parts, according to the present invention, wherein a multiphase-alloy billet of the part being produced is subjected to deformation by rolling an axially symmetric billet while rotating it about its own axis, with at least one roll which has at least three degrees of freedom, the deformation process occurring at a temperature exceeding about 0.4 m.p. of the multiphase alloy but below the temperature at which a total content of precipitates or an allotropic modification of the matrix of a multiphase alloy from which the billet under process is made is not below about 7%, while controlling the load applied by the tool to the billet in accordance with the following relationships:

$$\sigma_{SH} > q \geqq \sigma_{S\Delta} \quad (1)$$

$$K \cdot \sigma_{S\eta} > q \quad (2)$$

where $\sigma_{S\Delta}$—yield stress of the material of the billet portions subjected to deformation;

q—load by the tool on the billet under process;

$\sigma_{SH}$—strain resistance of the material of the billet portions not subjected to deformation;

$\sigma_{S\eta}$—strain resistance of the tool material at a strain temperature of the billet under process;

K—empirical coefficient ($K \leqq 2$), with the strain rate in the range from $10^2$ to $10^3$ $s^{-1}$; rolling of the billet is followed by its heat-treatment by heating it to a temperature above or below the temperature of dissolution of the second phase or of the allotropic modification of the matrix depending on the microstructure of the material resulting from the rolling procedure.

The following technological steps are expedient to be used when carrying into effect the method, according to the invention:

- rolling of the billet is preceded by plastic deformation of the billet central portion performed by compressing the billet with tail spindles which impart torque to the billet during its being rolled;
- rolling of the billet is accompanied with positive (clockwise) rotation of the billet and rolls, their angular velocities being approximately the same;
- the billet is rolled with at least two pairs of rolls, the straining loads for each roll of a pair are set to be the same at every instant of time;
- load moments for each pair of rolls are mutually balanced in accordance with the following relationship:

$$q_i \cdot S_i \cdot L_i = q_{i+1} \cdot S_{i+1} L_{i+1} \quad (3)$$

where $q_i$, $q_{i+1}$—specific load of the rolls;

$S_i$, $S_{i+1}$—billet-to-rolls contact area;

$L_i$, $L_{i+1}$—distance from the center of gravity of the contact area to the center of the billet rotation;

i=1,2,3,4 . . . —number of rolls;

- disk-type parts are rolled by alternative radial relative displacement of the rolls forming the inner surface of the disk rim over a distance not in excess of the length of the generatrix of the roll base cone;

disk-type parts are rolled with at least three rolls at a time, one of which forming the outer surface of the disk rim by imposing a load not exceeding the loads of the two other rolls that form the rim inner surface;

shell-type parts are rolled with rolls spaced differently apart from the center of the billet rotation;

shell-type parts are rolled by displacing the tail spindles relative to the initial rolling plane;

rolling is performed with an increased speed of radial roll displacement away from the disk axis;

intricate-configuration parts, such as combined ones of the disk-and-shaft type, are rolled with at least three rolls whose axes can rotate in the range of from 0 to 1 radian with respect to the axis of the billet rotation and make up an angle of from 0 to 2 pi ($\pi$) radian with the axes of other rolls;

rolling is performed with rolls displaced relative to the plane passing through the billet axis.

The foregoing objects of the present invention are achieved most efficiently when rolling of the billet is preceded by preconditioning the microstructure of billets from multiphase alloys by subjecting them to thermomechanical processing (TMP) consisting in that the billet is first preheated to a temperature at which a total content of precipitates or an allotropic modification of the matrix exceeds 7%, followed by stage-by-stage reduction of the treatment temperature down to the temperature of formation of a stable fine-grained microstructure, the ratio between the grain sizes of different phases not exceeding 10; subjecting the billet to deformation at each stage of temperature decreasing so as to reduce the billet cross-sectional area by about 1.2 to 3.9 times per stage.

It is expedient that the billet deformation at the stage of preconditioning its microstructure be carried out concurrently with preforming the billet for subsequent rolling.

A stage-by-stage reduction of the treatment temperature of the billet from nickel-base alloys is performed by providing a maximum increase in the amount of the γ-phase at each stage up to and including about 14%, and each stage of the thermomechanical treatment is followed by a post-deformation annealing at a temperature not exceeding the temperature of the beginning of deformation at a preceding stage of treatment.

It is also recommended that:

the strain rate at the first treatment stage ranges from $10^2$ to $10^{-3}$ $s^{-1}$, and the strain rate at the following stages is preset in accordance with the following relationship:

$$\epsilon_\eta = K_\phi \cdot \epsilon_{\eta p} \cdot T_{66}/T_{\eta p \phi} \quad (4)$$

where $\epsilon_\eta$—strain rate at a next stage;

$\epsilon_{\eta p}$—strain rate at a preceding stage;

$T_\Delta$—strain temperature;

$T_{\eta p \phi}$—temperature of the second phase complete dissolution;

$K_{100}$ —empirical coefficient depending on the chemical and phase composition of the alloy ($K_\phi$=0.5-2).

Provision of specially predetermined microstructure of the parts is favored, apart from the aforedescribed particulars of their production process, also by the following steps covered by and disclosed in the present invention:

rolling of billets from age-hardenable alloys is preceded by annealing the billets in a monophase region at a temperature not exceeding about 1.07 the temperature of complete dissolution of the γ-phase, followed by cooling down to a temperature not above the rolling temperature at a cooling rate that ensures a gain in the second phase from 5% per hour to 50% per hour, and postrolling heat treatment of the part is carried out at a temperature below the temperature of complete dissolution of the γ-phase.

the rolling procedure is preceded by annealing at least two adjacent billet portions so as to establish a temperature gradient therebetween, the temperature being changed in the range from about 0.8 the temperature of complete dissolution of the γ-phase in one billet portion to a temperature not above about 1.07 the temperature of complete dissolution of the γ-phase in the other billet portion, followed by cooling the billet down to a temperature not above the rolling temperature at a cooling rate that ensures an increase in the amount of the γ-phase from 5% per hour to 50% per hour, and postrolling heat treatment of the part is carried out at a temperature below the temperature of complete dissolution of the γ-phase;

rolling of billets is carried out in two stages, at the first of which the billet is subjected to deformation in a temperature range of superplasticity until the billet size gets equal to about 0.6–0.9 the part final size, after which the entire billet or its unrolled portion is annealed in a monophase region, followed by cooling the billet from the annealing temperature down to the temperature not above the rolling temperature at a cooling rate that ensures an increase in the amount of the γ-phase from 5% per hour to 50% per hour, whereupon the billet is rolled to the part final size and heat-treated at a temperature below the temperature of the γ-phase complete dissolution; at least two adjacent billet portions are rolled at different strain ratios that vary steadily from one billet portion to another by 0.25 to 0.75 the strain ratio of the adjacent billet portion.

BRIEF DESCRIPTION OF THE DRAWINGS

FIGS. 4,6,8 present photographic pictures of different-shape rolled parts;

FIG. 11 shows the macro- and microstructure of a rolled disk made of ]A962 alloy with the specified microstructure.

DESCRIPTION OF THE INVENTION

Figure 1:
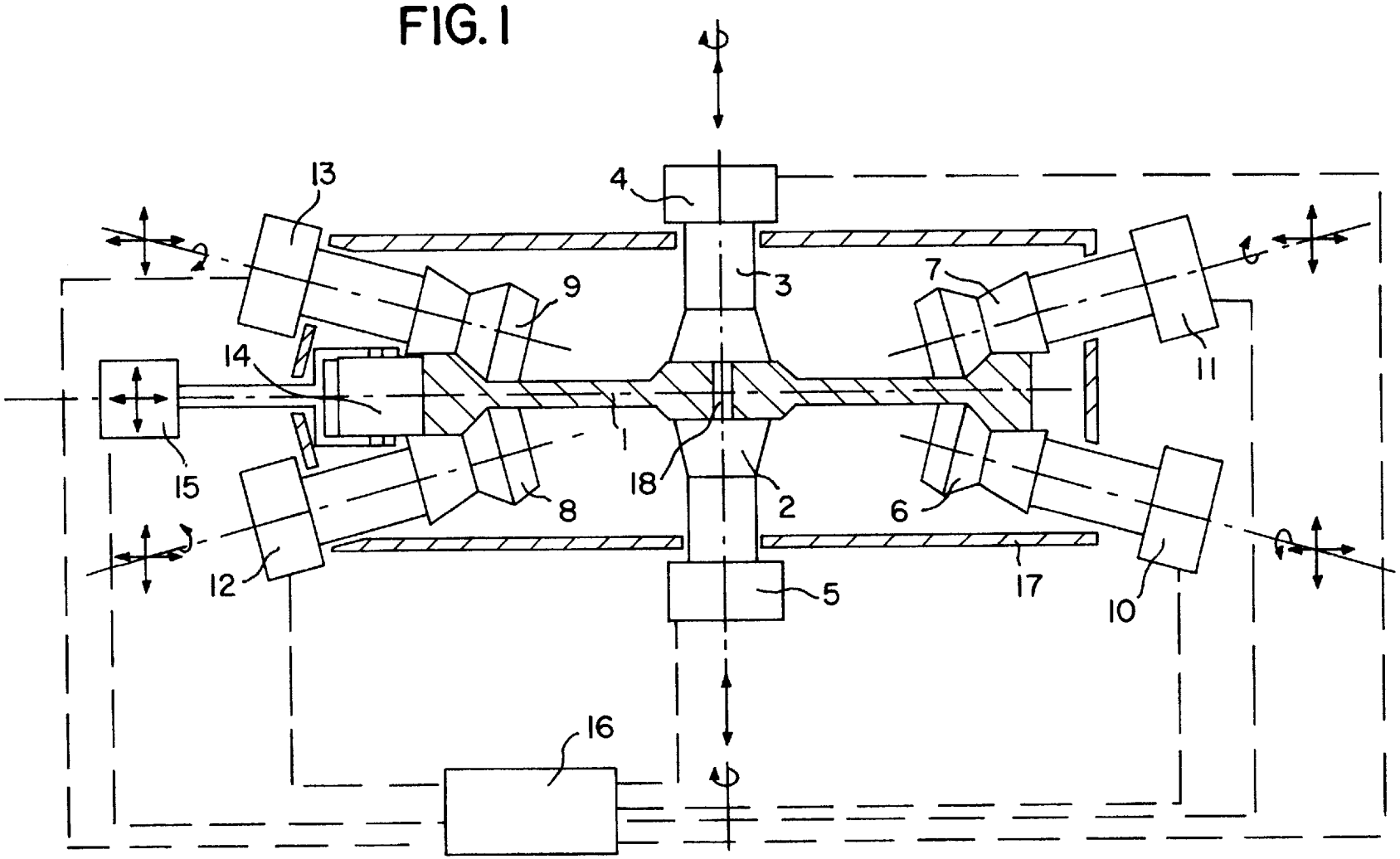
FIG. 1 is a schematic rolling diagram of axial-symmetric parts.

When producing axially symmetric parts from billets made of multiphase hard-to-work alloys, a billet is to be rolled in a definite range of temperatures and strain rates and with a definite load applied by the tool to the billet being rolled.

A specific rolling temperature is to be selected depending on a number of factors, i.e., for high-rate superplasticity and a higher temperature for high alloys, that is, the one that approximates the upper value in the above specified range ($10^2$ to $10^{-3}$ $s^{-1}$). This is connected with the fact that in both of the aforementioned cases, of importance is the part played by the diffusion processes which become, as is known commonly, more active with a temperature rise. For a conventional structural superplasticity and for medium alloys the temperature may be lower and may approximate the mean value of the above range, because in this case the microstructure of medium alloys is stable. It should be noted that the upper limit of the temperature range is dictated by a necessity to provide a structural stability of the material, which one of the most important prerequisite for the effect superplasticity to occur. In multiphase alloys their fine-grained microstructure remains stable (an average grain size being not over 10 micron), that is, it does not coarsen badly during the strain process, provided that a total amount of isolated phases or an allotropic matrix modification is not below 7% at the strain temperature.

For low alloys, as distinct from medium- and the more so as high alloys, the absolute value of the strain temperature is the lowest. The lower limit of the strain temperature at which such alloys exhibit super- and high plasticity depends on the grain size so that the smaller the grain size the lower the strain temperature. For an ultrafine-grained, i.e., nanocrystalline state of such alloys (with an average grain size from 20 to 200 nm) the strain temperature approximates 0.4 m.p.

Thus, the proposed method specifies a temperature range covering the necessary strain conditions for various compositions and structural states of the multiphase alloys involved.

According to the characteristic features of the present invention, straining occurs at rates corresponding to the state of high-or superplasticity. High-plastic state is present in the alloys in question in the case of rolling a fine-grained billet at high strain rates ($10^2$ to $10^{-2}$ $s^{-1}$), rolling a coarse-grained billet at low strain rates ($10^{-2}$ to $10^{-3}$ $s^{-1}$). Whenever a mixed microstructure has been established in the billet, consisting of fine and coarse grains, the strain rate is selected also in the range of $10^2$ to $10^{-3}$ $s^{-1}$, depending on the volume ratio of the structural components (i.e., the fine- and coarse-grained ones) and on that of their size, respectively. From the standpoint of the required level of technological plasticity, strain forces, and rolling rate the upper limit of the strain rate is limited to $10^2$ $s^{-1}$, and the lower one, to $10^{-3}$ $s^{-1}$.

It should be noted that use of the superplastic state in plastic metal working provide an efficient load reduction provided that plastic flow of metal is not constrained by applying high hydrostatic pressure. However, this merit may turn out to be a disadvantage when producing quite a number of low cross-section large-diameter axially symmetric parts, especially in cases where rolling is used as the straining process. This can be attributed to the fact that though said state provides high plasticity and low yield stress of virtually any materials, at the same time it hampers the process of forming a part by rolling. In said state even relatively low stresses cause plastic deformation in the already rolled billet portion, thereby resulting in loss of a preset shape, because a material in the state of superplastic strain behaves in many aspects as a viscous medium. That is why as distinct from conventional rolling, straining a material in the state of high- and superplastic deformation requires controlling the technological process parameters. This is carried out during the rolling process by controlling the strain temperature-and-rate conditions, the billet temperature, as well as the load application pattern and the value of the load applied. The said parameters determine the level of internal stresses in the billet and the level of the material strain resistance (yield stress) and eventually govern the billet shaping process. For instance, the yield stress in the already rolled billet portions can be increased by cooling them down. The load application pattern and the load value can be varied by presetting a definite pathway of rolls. It is common knowledge that in case of a complicated load application which is the case with rolling of axially symmetric parts using rolls, flow of the material under process occurs not only in the zone situated just beneath the rolling tool but also in out-of-contact zones. Here and hereinafter the term load is understood to mean not only a specific force exerted by a single tool on the surface of the part under process but also the resultant action of a group of tools on the part being rolled. It is rolls that enable both the load application pattern and the load value to be controlled.

The rolls have at least three degrees of freedom which are required for imparting a required shape to the part being rolled and load control, that is, rotation of each roll round its own axis and motion in at least two orthogonal directions, i.e., lengthwise and crosswise the billet radius. Thus, the tool action on the billet in order to produce the required part therefrom is so selected that the following requirements should be met:

1. The specific pressure (load) q applied to the billet-to-tool contact spot be sufficient, with regard to the effect of internal stresses, for overcoming the stress resistance of the material in the rolled (strained) billet portion ($\sigma_{s\Delta}$) and shaping the billet, whence $$q \geqq \sigma_{s\Delta}$$

2. The load q resulting from the action produced by the rolls on the billet so as to retain the shape and size of the disk in the nonstrained billet portions (including the already rolled ones) should be below the plastic strain resistance $\sigma_{SH}$ of the material of said billet portions, whence $$\sigma_{SH} > q$$

Otherwise speaking, the billet central and rolled portions should not be subjected to plastic strain during billet rolling under the effect of the stress that arises therein as a result of action produced by the rolls on the billet portion being rolled and by the tail spindles on the billet central portion;

3. As far as the rolling tool is concerned, it is necessary that the following relationship $$K \cdot \sigma_{S\eta} > q$$

should be satisfied, where $\sigma_{S\eta}$—yield stress of the tool material at the strain temperature of the billet under process;

K—empirical coefficient that allows for the tool working temperature conditions, tool shape and load conditions, as well as properties of the tool material (K<2), taking account of specific features of local disk shaping under conditions of high or superplastic strain.

Such a relationship makes possible that the value of q may exceed that of $\sigma_{S\eta}$. Such being the case, its satisfaction is accounted for by the following factors:

(a) Under conditions of superplastic strain a sufficient difference occurs between the yield point of the tool material and the billet material, said difference making possible producing a required part even the billet and the tool are made of the same material but substantially differing in grain size. For instance, the billet features a fine-grained microstructure, whereas the tool, a coarse-grained one.

(b) a rolling tool, that is, a roll is essentially a solid of revolution which contact the billet only with part of its surface at every instant of time and said contact roll surface changes incessantly its position relative to the billet due to roll rotation. As a rule, an average tool temperature during the rolling process is lower than the billet heating (strain) temperature. The particulars mentioned before prevent the substantial development of plastic strain in the tool.

Thus, a possibility is provided for rolling nickel-base alloys using a tool made of the same or similar superhightemperature nickel-base alloys but in as-cast state, which less expensive than use of a tool made of refractory metals and alloys.

Once rolled, the billet is to be heat-treated under conditions depending on its microstructure resultant from the rolling process. When the part has a fine-grained microstructure and its operating conditions require a prolonged high temperature strength, the part is to be heat treated by being heated to a temperature at which secondary recrystallization occurs, whereby the grain size increases. In cases where the "necklace"-type microstructure is obtained as a result of rolling, the temperature of heat-treatment for hardening is usually selected to be such that the matrix grains should retain their shape but part of the strengthening phase should dissolve so as to be isolated afterwards as dispersion particles. Another situation accounted for by the operating conditions is also possible where the heating temperature of heat-treatment is so selected as to retain fine-grained microstructure of the part providing high strength characteristics and a satisfactory short-time high-temperature strength, that is, when the fine-grained material is to be used in short-lived products.

When the billet is rolled with paired rolls it is important, to ensure against buckling, the moments from specific loads of rolls at the contact spot be mutually balanced according to the following relationship:

$$q_i \cdot S_i L_i = q_{i+1} \cdot S_{i+1} L_{i+1}$$

where $q_i$, $q_{i+1}$—specific load of rolls;

$S_i$, $S_{i+1}$—rollers-to-billet contact area;

$L_i$, $L_{i+1}$—distance from the center of gravity of contact area to the axis of the billet rotation;

i=1,2,3,4 . . . —number of rolls.

Such a mutual balancing of moments is necessary for each pair of rolls acting on the billet, since otherwise a difference between said moments will result, during rolling, in an undesired bending of the billet. When the billet is rolled with a large number of rolls, the forces and moments of each roll should be mutually balanced.

When rolling is accompanied by positive rotation of the billet imparted by the driving tail spindles and of the driven rolls, their angular velocities are matched to the values corresponding to a minimum slip therebetween, which adds to surface finish of the parts being rolled and to their accuracy, as well as to tool endurance.

The billet central portion is shaped by compression applied by the tail spindles with a load that develop plastic strain before rolling and elastic strain (together with the rolls) during rolling. Otherwise speaking, the billet is first reduced by being subjected to a small plastic strain to establish a well-developed contact between the billet and the spindles, and upon starting the rolling procedure the specific force is decreased to the values that cause, with a joint action produced on the billet by said spindles and rolls, stresses that provide only elastic strain of the billet central portion. Thus, conditions are provided for imparting torque to the billet. Whenever necessary, before beginning the rolling process the billet central portion is subjected to relatively high plastic strain, e.g., in cases where the disk hub should be thinner than the disk web.

The billet is to be rolled with at least two pairs of rolls, the deforming forces set for each roll at every instant of time being the same. Such a rolling procedure cuts down its machine time by at least 50 percent, because each pair of rolls works on only its own disk sector having angle $2.\pi/n$, where n is the number of roll pairs. In addition, such a rolling procedure balances the forces on the spindles and contributes to higher accuracy of the part produced, whenever the rolls are located on the diametrically opposite and feature equal feed rate and depth of penetration. When the magnitude of the angle between each roll pair is smaller than pi, so with the same force applied, the rolls will reduce only part of the disk and be arranged at different radii, thus ensuring their better operating conditions and prolonged service life without appreciable wear.

Rolling of disk-type parts is carried out by alternative radial mutual displacement of the rolls which shape the disk rim inner surface. Such a rolling with one roll and another in succession makes it possible to reduce load on the already shaped disk portions due to changing the direction of displacement and amount of the displaced volume at every instant of time as compared with the case where both of the rolls of a pair moves continuously at the same speed. It should be noted that mutual overlap of the rolls must be retained during their mutual displacement, as otherwise an unamendable flaw may result in the part under process. The amount of roll displacement is reduced to zero by the end of rolling.

Disk-type parts are rolled simultaneously with at least three rolls which establish a groove. One of said rolls shapes the outer rim surface by applying a force not exceeding that applied to the rim by the other two rolls shaping the inner surface of the disk rim. The essence of this technique resides in that under the action of the three rolls the metal of the disk rim flows in three dimensions, that is, parallel to the axis of the disk rotation, thereby increasing the rim height, as well as along and square with the billet radius, thereby increasing the rim diameter. Such a technique extends the range of disk types that can be produced because disks with well-developed rim surface or with a wide rim can be obtained.

Shell-type parts are rolled by either periodical or continuous displacement of the tail spindle relative to the initial rolling plane by a total length equal to the preset deflection of the part under process. Combined motions of the spindles and rolls make possible, according to this technique, production of parts having tapered surface or of a preset curvature.

Shell-type parts can also be rolled by rolls spaced differently apart from the center of the billet rotation. This technique in combination with that mentioned above allows of producing shell-type axially symmetric parts as well.

Rolling is carried out while gradually increasing the speed of radial roll displacement away from the disk axis. The essence of this technique resides in that as rolling proceeds the billet volume being displaced is decreased, thus contributing to higher rolling speed and hence to shorter operative time.

Intricate-configuration parts, such as combined ones of the disk-and-shaft type, are rolled with at least three rolls whose own axes can be turned in the range of from 0 to 1 radian with respect to the billet axis of rotation and make up an angle of from 0 to $2.\pi n$ radian with the axes of other rolls. The aforementioned range of variation of the roll angles enables the shaft and the disk portions of a combined part to be rolled either simultaneously or in succession. The angle of turn of the roll equal to 1 radian provides a required tilt of the rolls relative to the part portion being rolled.

The billet is rolled with rolls displaced relative to the plane passing through the billet axis by a length not exceeding an average radius of the tool working portion. A change in the roll position involves a change in the direction of action of the rolling force components. This makes it possible to control, within certain limits, the stresses arising in the billet rolled portion and in its portion which is being rolled. The limiting values are in this case those of displacement that should not exceed the aforesaid preset value. If otherwise, the billet may be undercut with the formative tool surfaces.

Preconditioning of the structure of nickel, titanium and iron-base multiphase alloys provided by the present invention is aimed at establishing either a fine-grained homogeneous structure throughout the volume of a billet or a special inhomogeneous structure. In both cases the techniques mentioned above are aimed at establishing a specified structure in parts under process. Provision of such a structure is ensured due to a multistage thermomechanical processing of billets.

The thermomechanical process begins with billet heating to a temperature at which a total second-phase content of the alloy is at least about 7%, whereupon a stage-by-stage temperature reduction is performed until a fine-grained microstructure is obtained, wherein the ratio between the sizes of the matrix grains is not in excess of 10. It is under such conditions that the fine-grained structure is stable. The aforementioned conditions determine a temperature range in which billet deformation results in grain refining due to dynamic or static recrystallization occurring in the alloys. The aforesaid deformation is carried out at each stage of temperature reduction so as to reduce the billet cross-sectional area by about 1.2 to 3.9 times per stage.

Stage-by-stage reduction of the processing temperature is necessary for a successive increase in the content of the second phase or of the allotropic matrix modification, whereby the grains are refined from stage to stage in order that stable states of fine-grained microstructure are obtained, the so-called nanocrystalline state inclusive.

It is necessary that for nickel-base alloys containing a considerable proportion (up to 60–70%) of second phases and wherein recrystallization is controlled by the processes of precipitation and coagulation of the γ-phase, the conditions for the γ-phase precipitation and, accordingly, the temperature conditions at each process stage be specified. When performing thermomechanical processing a stage-by-stage reduction of the temperature of processing billets from nickel-base alloys should be effected so as to provide a maximum 14% gain in the amount of the γ-phase at each stage. At the end of each stage of the thermomechanical processing postdeformation annealing should be performed at a temperature not exceeding that at the beginning of the deformation process in the preceding stage. It is important that a gain in the amount of the γ-phase not exceed 14% at each stage, as otherwise an abrupt reduction of plasticity occurs due to an additional precipitation of a considerable amount (over 14%) of the γ-phase, where said reduction results in disturbed continuity during plastic strain of the material. On the other hand, as far as titanium-base alloys are concerned which contain plastic phases producing no abrupt embrittling effect, to specify an additional precipitation of the other phase is not obligatory.

A stage-by-stage repeated deformation of nickel-base alloys involving interstage annealing procedures results in gradual refining of the microstructure. It is due to a many times repeated alternative operations of strain hardening and softening of the material due to primary recrystallization that an ultrafine-grained microstructure is formed, consisting of the grains of an equilibrium (at the process temperature) solid solution of the γ-phase and the grains of the γ-phase, i.e., the so-called microduplex structure. The deformation ratio at each stage should be multiple of a 1.2 to 3.9 times change in the initial cross-sectional area or of a change at the preceding stage. The cross-sectional area is not to be changed by more than four times per stage, since lower strain values ensures to a sufficient extent preparing the microstructure for recrystallization. If otherwise, the continuity of the material may be disturbed as well, especially during the upsetting procedure which is used for preparing the billet for rolling. With the strain values below 1.2, the deformation ratio may amount to critical in some billet portions, thus resulting in grain size variation, whereas the strain value in he range from 1.2 to 3.9 is sufficient for intensifying the coagulation of the particles of the γ-phase, increasing particle size and interparticle spacing, as well as accumulation and redistribution of flaws. Thus, favorable conditions are provided for dynamic and static recrystallization to occur at each stage.

With a view to providing the most complete recrystallization processes, predominantly in nickel-base alloys, post deformation annealing should be performed at the end of each stage. Said annealing causes structural changes which provide formation of fine-grained microstructure and at the subsequent stage it adds to plasticity and reduces strain resistance.

The higher the alloy and the lower the annealing temperature (compared with strain temperature), the longer the holding time for the static recrystallization to occur is required. The holding time depends on the strain temperature, as well as on chemical and phase compositions of the alloys involved.

The annealing temperature is to be chosen within the range from the strain temperature to the temperature at which the additional second-phase precipitation does not exceed 14%. In this case, the amount of the phase corresponding to its equilibrium content at the annealing temperature should be used in calculations.

Final deformation by rolling prepared-microstructure billets under superplasticity temperature-rate conditions enables quality axially symmetric parts with homogeneous fine-grained microstructure to be obtained. Subsequent heat-treatment makes afterwards possible producing parts with preset microstructure parameters providing the required set of properties either isotropic in every portion of a part or varying steadily over the part cross-section due to formation of the part portions having fine- or coarse-grains, respectively.

Final postrolling heat-treatment of fine-grained microstructure parts intended predominantly for operation at temperatures approximating the aging temperature of alloys should be carried out by heating them to a temperature above that of the second-phase dissolution or at the low temperature of the allotropic matrix modification for a period of time long enough for the grain size to increase by about 2–10 times.

It is important to emphasize that in the modern and perspective products for use in heavily loaded power plants and in aerospace engineering an improved level of performance characteristics is provided due to the formation of a specific grain-boundary and intragranular structure therein, e.g., of the "necklace"-type, as well as coarse-grained microstructure with the serrated grain boundaries resultant from the complex thermomechanical processing. In addition, as has been mentioned before, it is necessary to form the specified microstructure over the part cross-section in order to provide a set of properties optimized in view of the actual operating conditions.

When a special microstructure is to be obtained, e.g., that of the "necklace"-type which is either homogeneous or specifically changing over the cross-section of a part made of high-temperature strength nickel-base alloys, said microstructure is obtained by varying the initial (prerolling) billet microstructure, the straining and heat-treatment conditions. Parts with this type of microstructure will be applied in the future-generation products, in particular, in the aerospace engineering.

Formation of the abovesaid microstructure may be carried out using the following two methods.

1. By using a billet with a prepared coarse-grained microstructure obtained by any conventional methods, for example, powder metallurgical technique.

2. By using a billet with a prepared fine-grained microstructure obtained by the method described above.

In both of the methods mentioned above, the rolling process is preceded by heating either the entire billet under process or its unrolled portion in the monophase region but not higher than about 1.07 the temperature of complete dissolution of the γ-phase. Specific annealing temperature and holding time are selected depending on the initial and preset final microstructure parameters in the whole billet or in a portion thereof. In the latter case it is expedient to use a billet with the prepared fine-grained microstructure. This is followed by cooling from the annealing temperature to the temperature not exceeding the strain temperature, at a rate that provides a gain in the γ-phase from 5% per hour to 50% per hour, and postrolling heat treatment of the part is carried out at a temperature below the temperature of complete dissolution of the γ-phase.

The controlled cooling from the recrystallization temperature carried out in the cooling rate range providing the γ-phase gain in the range from not less than 5% per hour to not more than 50% per hour allows of uniformly precipitating the dispersed γ-phase inside the matrix grains. Cooling of the alloy from the recrystallization temperature at a rate below 5% per hour results in an excess γ-phase coagulation, its coarsening, and formation of wide boundary areas free from precipitation, with the resultant recrystallization during subsequent deformation and formation of a structure of the micro-duplex type. Furthermore, low cooling rates result in undesirable precipitation of carbide phase with unfavorable morphology. On the other hand, the cooling rate above 50% per hour results in precipitation of the dispersed γ-phase which affects badly the plasticity of the material under process. Cooling of alloys in the preselected range of rates and the following strain under the superplasticity temperature-rate conditions allow of producing a stable substructure inside the thermally strained grains. The cooling process running at constant or varying rates allows of obtaining the required second-phase morphology, which is of paramount importance for forming optimum structure states to ensure the required set of properties. The structure type varies substantially depending on the degree of final strain. 55–75% strain provides a complete processing of the material and establishing a stable "necklace"-type structure homogeneous over the entire part volume. This structure state is optimal for providing high strength and low-cycle fatigue at moderate temperatures (450–650° C.). As the degree of strain decreases from about 55% to 35% the proportion of the fine-grained component in "necklace" structure decreases, with the metallographic texture decreasing, too. After a 15–35% reduction, the formation of a coarse-grained structure with serrated grain boundaries occurs, whose strength characteristics are interior to those of the "necklace" structure. However, said structure exhibits higher temperature-strength characteristics due to its being free from a fine-grained plastic interlayer between coarse thermally strained grains. A structure with the serrated grain boundaries possesses the highest temperature-strength characteristics at elevated temperatures (650–750° C.).

To stabilize an appropriate-character microstructure in the various part areas, obtained due to strain under superplasticity conditions, and provide a high-level set of properties due to additional precipitation of the dispersed strengthening γ-phase, heat-treatment at a temperature below the temperature of complete dissolution of the γ-phase is to be carried out.

Obtaining a specific structure in nickel-base alloys making it possible to provide a higher level of performance characteristics of parts, is attained, according to the present invention, due to some further steps that follow.

Before rolling a billet at least two adjoining billet areas are subjected to annealing with establishing a temperature gradient. The annealing temperature is changed in the range from about 0.8 the temperature of complete dissolution of the γ-phase in one of the billet portion to the temperature not exceeding about 1.07 the temperature of complete dissolution of the γ-phase in the other billet portion. Such a step is necessary for establishing in the part under process steady variation of grain size from fine-grain size in the part portion heated to about 0.8 the temperature of complete dissolution of the γ-phase to coarse-grain size in the part portion heated to about 1.05 the temperature of complete dissolution of the γ-phase, wherein a structure of the "necklace"-type is established, resulting from the final deformation.

A similar effect can be obtained in the case where the rolling procedure is carried out in at least two adjoining billet portions with the different deformation ratios varying steadily from one billet portion to another by about 0.25 to 0.75 the deformation ratio of the adjacent billet portion. Thus, it is due to a specified change in the deformation ratio one billet portion to another that the desirable change in the microstructure and mechanical properties over the cross-section of a disk-type part can be obtained.

It is also expedient that when producing parts with the preselected specified microstructure from billets with the prepared fine-grained microstructure, recrystallization annealing be carried out during the final deformation procedure rather than after thermomechanical processing. The rolling procedure is carried out in two steps, i.e., at the first step the billet is reduced, in the superplasticity temperature range, to the size equal to about 0.6–0.9 of the final part size. Thus, it is due to billet size reduction in the preset limits under superplasticity conditions under which the billet has a fine-grained structure that the process gets more economic.

At the second step when a coarse-grained microstructure with intragrain dispersed γ-phase precipitates is established in the billet, resulting from annealing and cooling, the deformation process is carried out at low strain rates but quite enough for forming a special preselected microstructure.

Shape-forming operations can be done concurrently with postannealing billet cooling down to the strain temperature. At the initial instant of time the strain rate is reduced by 10–100 times, while by the end of the cooling process the strain rate is increased again to the preselected one. This approach makes it possible not only to increase the productivity of the technological process but also to obtain a new microstructure modification.

It is due to performing a low-rate cooling under the effect of a constantly applied stress resulting from concurrent running of said operations and final deformation by rolling that a structure is formed in the part featuring a markedly pronounced texture of its components.

The rolling procedure is carried out according to the diagram of FIG. 1, wherein 1 denotes billet; 2 and 3, tail spindles; 4 and 5, tail spindle drives; 6 through 9, inclined rolls; 10 through 13, inclined roll drives; 14, pressure roll; 15, pressure roll drive; 16, rolling mill operating system including central computer, converting actuators (not shown), control units, and feedback. The device further comprises an operating chamber (furnace) 17 with a temperature control and maintenance unit (not shown in FIG. 1). The furnace has a special opening for receiving the working tools and the tail spindles. The direction of possible motions and rotation of the working tools are also indicated with arrows. Technological axis is for centering the billet in the tail spindles.

Ref. No. 19 denotes the billet of an intricate-shape disk being produced (FIG. 2).

Figure 3:
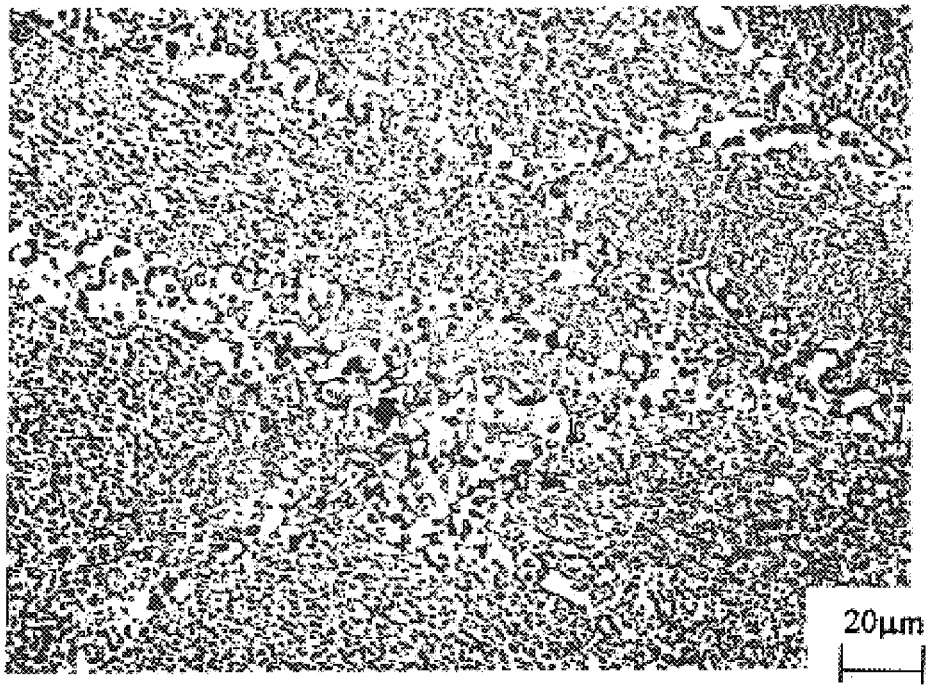
FIG. 3 illustrates the microstructure of a rolled disk made of ¥Å962 alloy.

Ref. No. 20 denotes the billet of a shell-type part being produced (FIG. 3).

Figure 4:
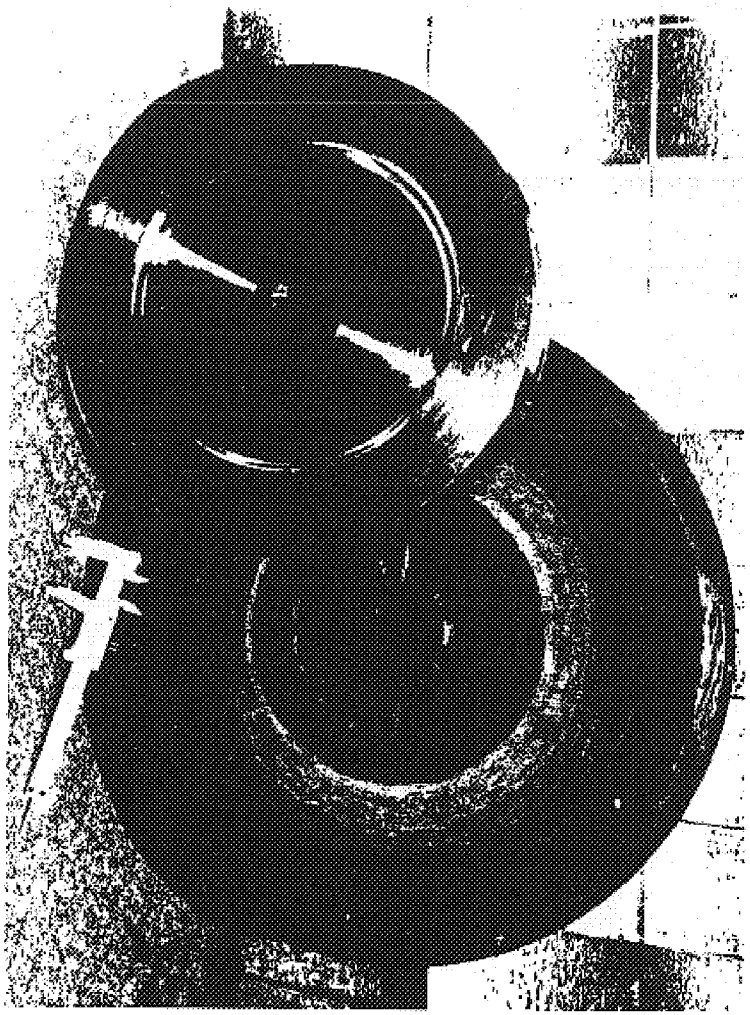

Ref. No. 21 denotes the billet of a combined part of the disk-and-shaft type (FIG. 4).

Ref. No. 22 denotes a mandrel for shaping a shaft.

EXAMPLE 1

Figure 2A:
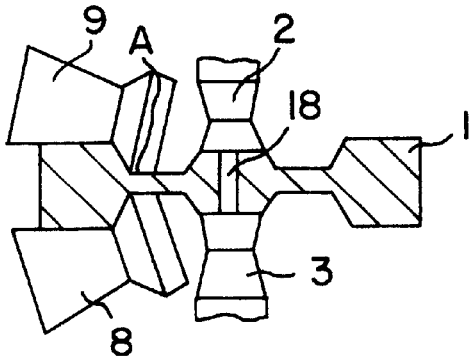
FIG. 2 is a schematic rolling diagram of an intricate-shape disk.
Figure 2D:
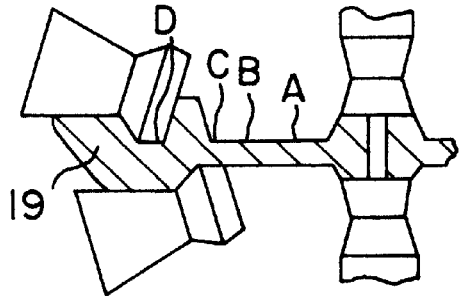
Figure 2B:
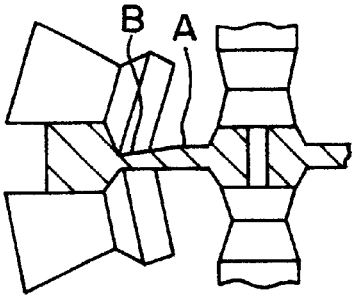
Figure 2E:
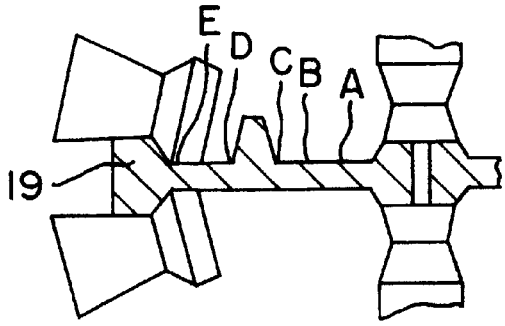
Figure 2C:
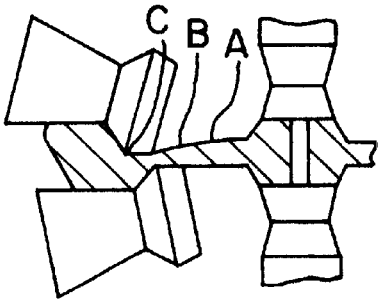
Figure 2F:
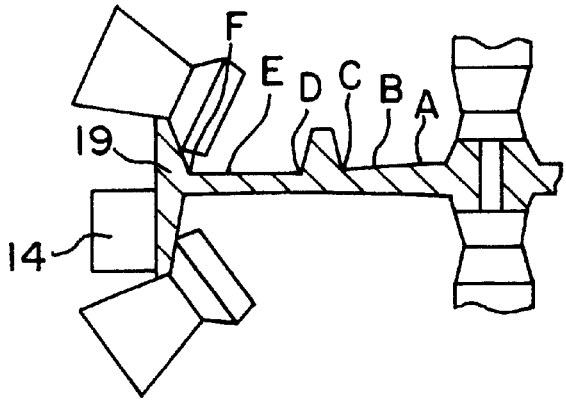

The billet is a die-forging from the ]A962 nickel-base alloy having an original fine-grained microstructure. The shape of the part to be produced in its original state is shown at Ref. No. 1 in FIG. 2*a*. The diameter of the die-forged billet is about 400 mm, hub thickness, 70 mm. The alloy is subjected to plastic working at a superplasticity temperature (1100° C.), at which the strengthening γ-phase content exceeds 7%. The central billet portion is worked (reduced) first, using the tail spindles 2 and 3 with a specific load exceeding the strain resistance of the hub material. It is due to the resultant plastic deformation that the hub having the required dimensions is shaped, and a well developed physical contact between its end face and the tails spindles is obtained, which is of great importance for torque transmission from the rolling mill to the billet being worked. Then the load applied by the tail spindles is reduced. Once the hub has been shaped the drives for rotating and displacing the rolls 6–9 are turned on (the rolls 6 and 7 are omitted in FIG. 2, because they are located symmetrically to the rolls 8 and 9), whereupon the billet undergoes successive working (reduction) at strain rate of $10^{-2}$ $s^{-1}$, starting from that billet portion which immediately adjoins the hub and further towards the peripheral billet portions, applying a specific load and a stress exceeding the strain resistance (and not lower than the yield point) of the billet portion being rolled. Once the applied load exceeds the permissible value, the strain rate is reduced to $2\times10^{-3}$ $s^{-1}$, and the rolls change their position by about 6 mm relative to the meridian plane (that is, plane passing through the billet axis of rotation). The amount of said roll displacement does not exceed the average radius of the tool working portion. These steps allow of reducing the radial component of the rolling force and, accordingly, the radially directed stress component, i.e., the load in this particular case. As a result, the tool load is reduced to the permissible value, that is, to the yield stress of hub material which is required in accordance with relationship 1. This in turn stops the perceptible tendency to reduction of the web thickness in the disk and hub rolled portion. Then the rolling procedure is carried out from point A to point B illustrated on the billet profile (FIG. 2*b*) with equally changing billet reducing force (i.e., depth of penetration of the rolls into the billet) produced by all rolls, and with equally changing roll displacement speeds. The result is a decreased web thickness (due to a large depth of penetration of the rolls into the material), and the rolling speed is increased, since the displaced billet volume is reduced as the rolling procedure occurs. This in turn makes allows one to change the aforesaid parameters without increasing the load beyond the values. Changes in the billet thermomechanical strain conditions (that is, equal roll-to-billet axis distance, equal reduction, concordant angular velocities of the billet and rolls, equal load moments for each pair of rolls) identical for all inclined rolls, effective on the aforesaid rolling section, provide balancing of the rolling forces and moments thereof, which in turn allow the shaping of the disk profile in accordance with the drawing. Further rolling is performed from point C to point D with the top roll displaced radially with respect to the bottom one (FIG. 2*c*). The bottom roll moves radially and axially at a time relative to the billet so that its formative surface shapes a ridge (FIG. 2*d*). At the last step of the ridge formation the direction of roll motion is reversed (i.e., from that away from the center to towards the center) in order to increase the ridge height and reduce the allowance. Then the rolling procedure from point C to point F is carried out consecutively by the rolls 6, 7 and 8, 9. Further rolling from point E to point F is carried out by three rolls at a strain rate about $10^{-1}$ $s^{-1}$. The load applied by the roll that shapes the rim outer surface is not in excess of that applied by the inclined rolls that shape the inner rim surface (FIG. 2*f*). As a result, the rim with a well developed surface, i.e., that having a height exceeding the respective dimension of the original billet.

EXAMPLE 2

A die-forged billet from the ]A962 alloy is rolled, having an original fine-grained microstructure, the grain size being 5.5 and 2.5 microns in the γ- and γ-phases, respectively, and a coarse-grained microstructure with the grain size of 150 and 35 microns for the γ- and γ-phases, respectively. The die-forged billet with an original fine-grained microstructure is carried out at 1075° C. at a strain ranging from $10^{-2}$ to $10^{-1}$ $s^{-1}$ and the billet with an original coarse-grained microstructure is carried out at 1100° C. at a strain ranging from about $10^{-3}$ to $10^{-2}$ $s^{-1}$. The pathway of the rolling-off rolls has been preset in accordance with the drawing. Use is made of the techniques described in Example 1. As a result, disks with a homogeneous fine-grained microstructure and the "necklace"-type microstructure are obtained. The fine-grained disk is heat-treated by being heated above the temperature of complete dissolution of the strengthening γ-phase (1145° C.), and the disk with the "necklace"-type microstructure, at 1100° C. Then both alloys are subjected to aging under the following conditions: holding at 850° C. for 6 hours, followed by air-cooling; holding at 800° C. for 16 hours, followed by air-cooling. After final heat-treatment the disk with the original fine-grained microstructure exhibits a homogeneous coarse-grained microstructure, while in the second disk with the "necklace"-type microstructure displaying a high complex of properties (Table 1) said microstructure appears more clearly (FIG. 3). An external appearance of the second rolled disk presents in FIG. 4.

EXAMPLE 3

Figure 5A:
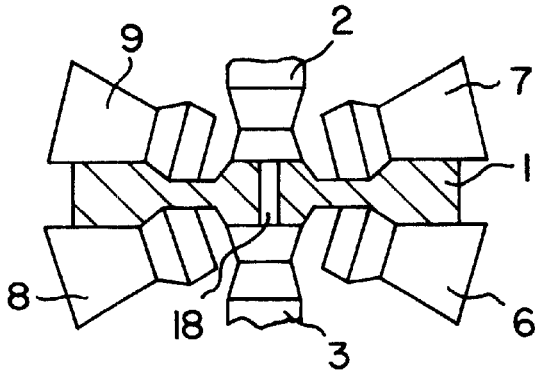
FIG. 5 is a schematic rolling diagram of a shell-type axially symmetric part.
Figure 5B:
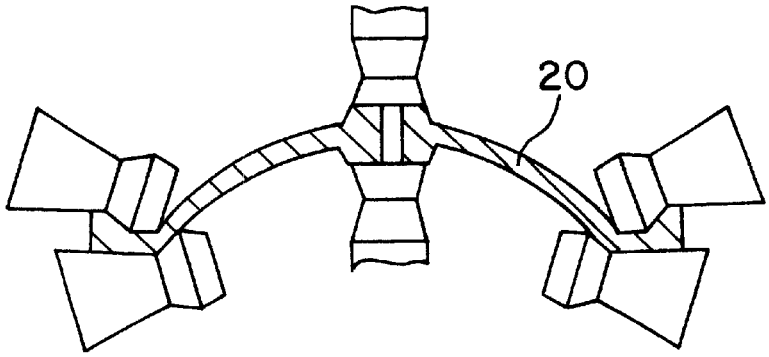
Figure 5C:
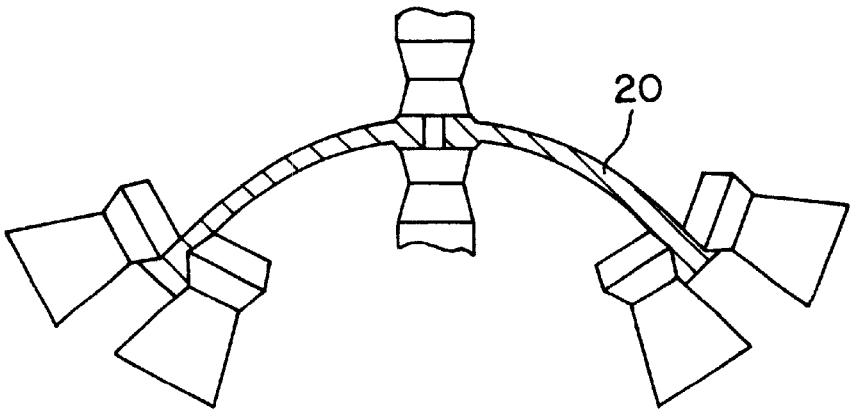

An elliptical shell made of the BT9 titanium-base alloy with the fine-grained microstructure close to the nanocrystalline one (FIG. 5) is rolled by two pairs of rolls. The strain rate at the beginning of rolling approximates $10^0$ $sec^{-1}$ and at the end, $10^2$ $sec^{-1}$. FIG. 5*a* illustrates the initial position of the rolls and billet before rolling. The preset billet profile is formed by successively displacing its central portion (hub) by the tail spindles for a length equal to the deflection δ of said portion relative to the original plane of the shell rolling without turning the rolls (FIG. 5*b*) and with turning the rolls (FIG. 5*c*). As a result of the rolling procedure, the part of the required profile (FIG. 6) is obtained, having a homogeneous microstructure over its whole cross-section.

EXAMPLE 4

Figure 7A:
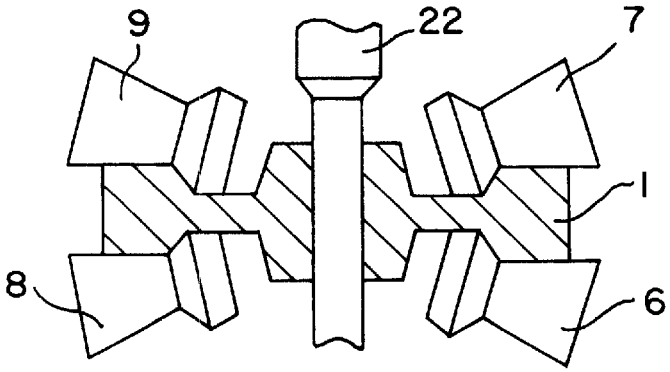
FIG. 7 is a schematic rolling diagram of a combined disk-and-shaft type part.
Figure 7B:
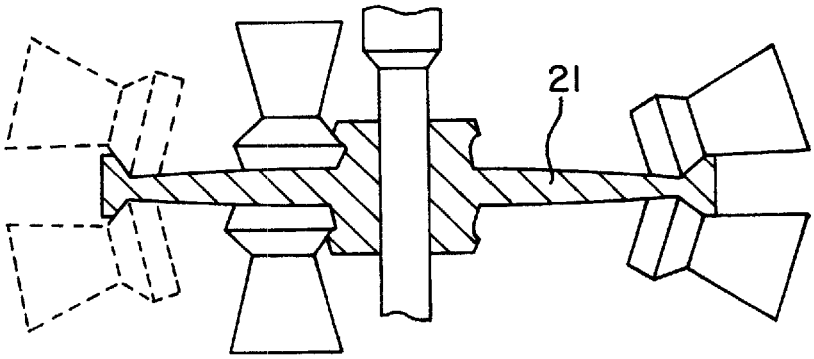
Figure 7C:
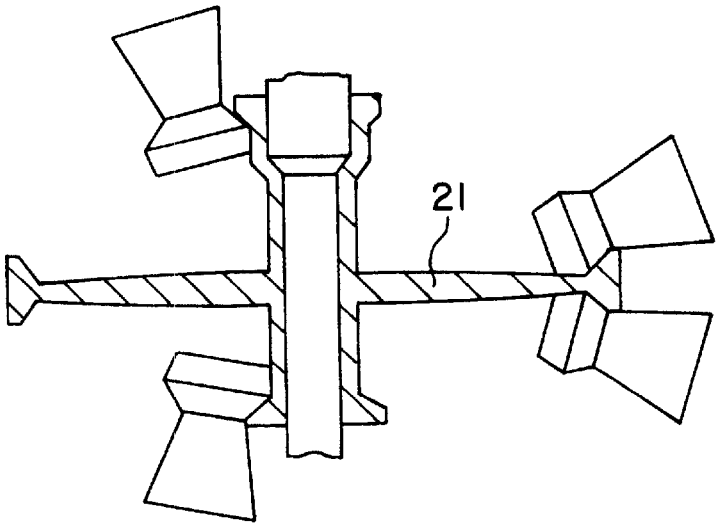
Figure 8:
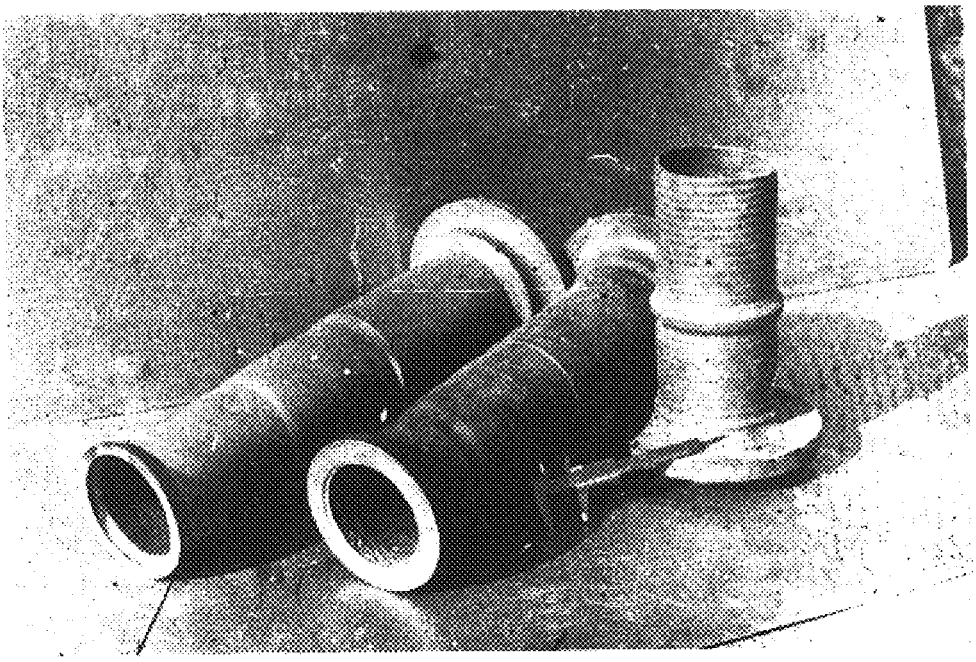

The billet of a combined disk-and-shaft type part, made of high-temperature age-hardenable austenitic steel is rolled by two pairs of rolls. The angle between the rolls is changed from 0 to π/2. In the initial state the steel has a fine-grained structure. As seen in FIG. 7 first part of the disk web is rolled by the rolls jointly but layer-by-layer (FIG. 7*a*). Once a room enough for the rolls to place has been formed near the hub portion, the rolls 8 and 9 are turned through an angle approximating 75° (FIG. 7*b*), and the shaft is rolled using the mandrel 22. The final rolling is carried out by only three rolls, because the lower shaft end has been rolled before the upper one due to its being shorter in length. (FIG. 7*c*). Another combined part with unilateral shaft arrangement is rolled in the same way but with three rolls, one of which shapes the shaft (FIG. 8).

EXAMPLE 5

The billet of a disk made of the ]A975 nickel-base alloy (known also as θE6I) with an original fine-grained microstructure is rolled. Use is made of rolls from the θE6I as-cast alloy. The strain rate is as follows: $10^{-3}$ $s^{-1}$ at the beginning and $10^{-1}$ $s^{-1}$ at the end of the rolling procedure. An average temperature in the working zone is 1145° C., the rolling time being 2 hours, and an average load being about 150 MPa. The maximum contact stresses are about twice as high as the strain resistance displayed by specimens of the θE6I alloy when tested for stress-rupture strength for a period of time and at a temperature respectively equal to those of rolling. The visible strain and wear were not determined. However, no noticeable tool deformation and wear has been found after the disk rolling procedure. Such a tool endurance is due to its shape, shielded from overheating, and heat withdrawal.

Given below are exemplary embodiments of preparing the microstructure of billets and rolling said billets into parts having specified microstructure and properties.

Used as the starting material for carrying the method into effect is an iron-base alloy (A-286) of the following composition:

Fe—25Ni—15Cr—2Ti—1.5Mn—1.3Mo. Also nickel-base alloys, grades ]3698, ]A962, and ]A975 differing in chemical composition and in the amount of the γ-phase, ranging from 24% to 55%. Originally, the billets of said alloys having a diameter of 150–200 mm have been obtained from castings of the ]3698, ]A975, ]-286, and ]A962 alloys using conventional press-forming or hot forging technique.

Before working the billets made of nickel- and iron-base alloys undergo the heterogeneous annealing by being heated to the temperature of a monophase zone, followed by cooling down to the ageing temperature at a rate of 5–10%/hour. As a result of such heat-treatment, a maximum amount of the coagulated γ-phase with the grain size of 0.2 to 0.8 micron is uniformly precipitated in the coarse-grained alloy matrix with the grain size of 50 to 150 micron.

EXAMPLE 6

Figure 9A:
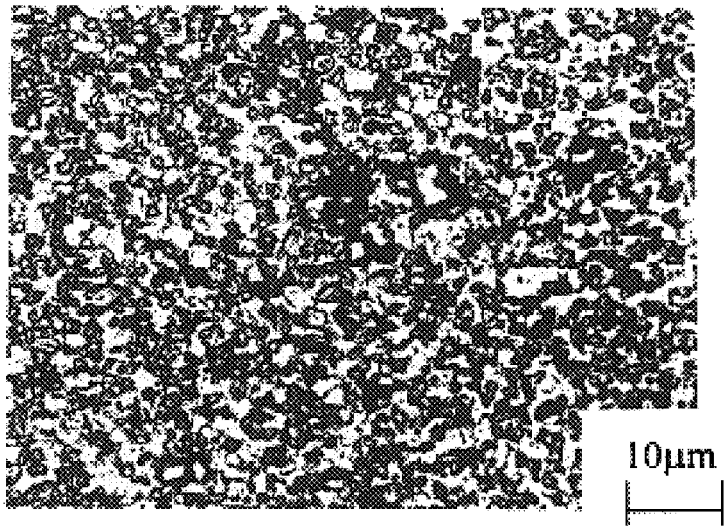
FIG. 9 shows the microstructure of ¥Å962 (a) and ¥Å975 (b) alloys after thermomechanical processing.

A billet made of the ]A962 alloy is upset in three stages in an isothermal die-set on a press with a force of 1600 ft at a temperature ranges from 1100 to 1025° C. A change in the degree of the billet deformation in going from one upsetting stage to another is proportional to a change in the cross-sectional billet area obtained at the preceding stage by 1.3, 1.5, and 2.5, respectively. As the temperature drops the holding time during annealing increases from 4 to 8 hours. With the stage-by-stage decreasing of the working temperature from 1100 to 1025° C. at each stage consisting of deformation and subsequent annealing, a gain in the γ-phase equals 6–8%. Thus, the working of a billet results in that a homogeneous fine-grained microstructure of the "microduplex"-type with the grain size of the γ- and γ-phases equal to about 2.5 and 1.3 micron, respectively, is established virtually in the entire volume of the worked billet, the γ-phase volume fraction being 31% (FIG. 9*a*). Then the billet is rolled under conditions of Example 1.

EXAMPLE 7

Figure 9B:
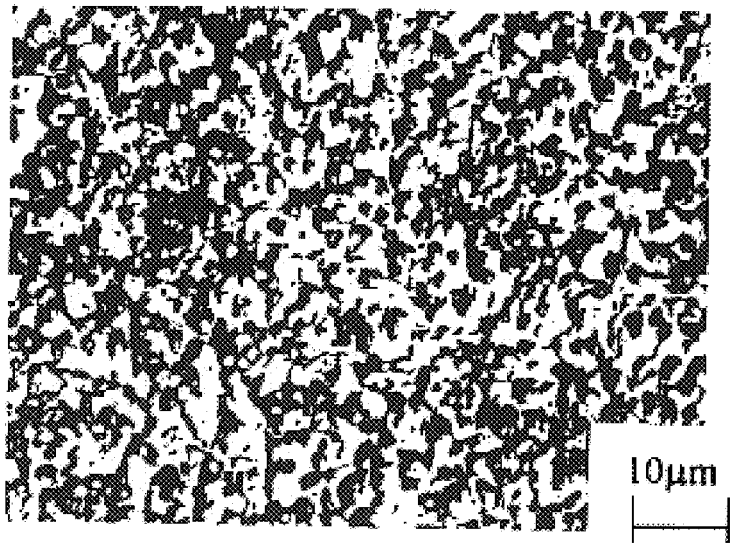

A hot press-forged billet 150 mm in diameter and 250 mm in height, made of the ]A975 alloy undergoes thermomechanical processing with a stage-by-stage (in four stages) reduction of the working temperature from 1150 (17% content of the γ-phase) down to 1025° C. Thermomechanical processing is carried out at the first and second stages with a 45–90 turn of the direction of upsetting, a total degree of deformation at a next stage being equivalent to a degree of deformation proportional to a change in the cross-sectional area at the preceding stage by a factor not over 3.9. The annealing temperature ranges from that of deformation but not below by more than 50° C., while a gain in the γ-phase at each stage is below 10%, and the holding time is 6–24 hours. Thermomechanical processing in a temperature range from 1150 to 1080° C. results in establishing a microduplex structure with the grain size of the γ- and γ-phases equal top 4.7 and 2.6 micron, respectively, and the γ-phase volume fraction equal to 32%. Further reduction of the working temperature down to 1060–1025° C. results in additional precipitation of the γ-phase and refining of the microstructure. The degree of deformation at stage 3 and stage 4 is equivalent to that proportional to a change in the cross-sectional area by 2.5 and 2 times, respectively. As a result of working in a temperature range from 1060 to 1025° C. a "microduplex"-type structure is obtained with the grain size of the γ- and γ-phases equal to about 3 and 2.2 micron, respectively, and the γ-phase volume fraction equal to 46% (FIG. 9*b*). Thereupon the billet is rolled under conditions of Example 1.

EXAMPLE 8

Figure 10A:
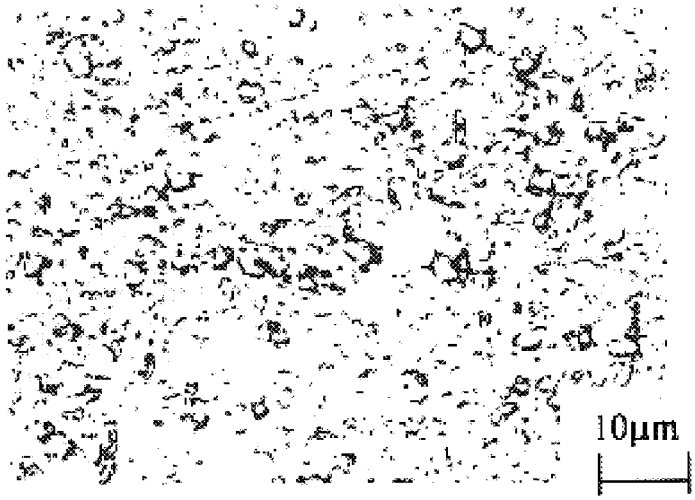
FIG. 10 shows the microstructure of ¥ẽ698 (a) and A-286 (b) alloys after thermomechanical processing.
Figure 10B:
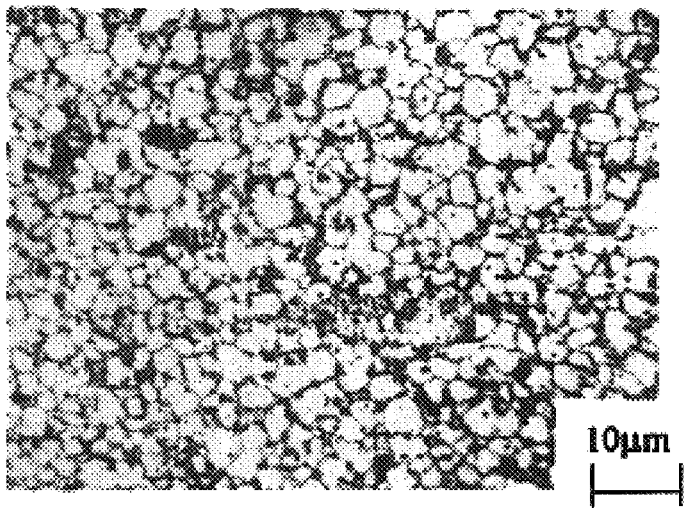

Billets made of the A-286 and ]3698 alloys, 150 mm in diameter and 250 mm in height undergo thermomechanical processing with stage-by-stage (in two stages) reduction of the working temperature from 975° C. (12% content of the γ-phase) down to 900° C. for the ]3698 alloy, and from 900° C. down to 825° C. for the A-286 alloy. The degree of deformation at stage 1 and the following stage 2 is equivalent to that proportional to a change in the cross-sectional area the initial and the preceding stage 1 by 2.5 and 2 times, 15 respectively. After the thermomechanical processing a microduplex structure with the grain size of the γ- and γ-phases equal to 2.7–3.5 and 0.9–1.1 micron, respectively, is formed, the γ-phase volume fraction being 11 and 19% (FIG. 10).

Thus, as a result of processing the billets under the 20 conditions stated in Examples 6–8, fine-grained microstructures are therein formed, whereby superplastic properties are exhibited by the worked billets compared to their initial state (see Table 2).

EXAMPLE 9

Hot-forged billets from the ]A962 alloy, 200 mm in diameter and 350 mm in height undergo thermomechanical processing with stage-by-stage (in 3 stages) reduction of the working temperature from 1100° C. (17% γ-phase) to 1060° C. The annealing temperature falls within the range of the strain temperatures, but not below said temperature by more than 20° C., the gain of the γ-phase volume fraction being below 10% at each stage. After thermomechanical processing at temperatures from 1100 to 1060° C. upset billets 400 mm in diameter are obtained for subsequent rolling. The microstructure of the formed billets is of the microduplex type having the grain size of the γ- and γ-phases equal to 5.5 and 2.5 micron, respectively, the volume fraction of the latter phase equal to about 26%. The resultant billet is clamped in the central (hub) area by the tail spindles. Before the rolling procedure the temperature inside the furnace of a disk-rolling device is increased up to the annealing temperature in the monophase γ-zone, and the billet is held at 1170+10° C. for 1 hour. One billet is heated completely to 1170° C., whereas the other one is annealed under conditions of a temperature gradient. The temperature of the hub portion of the billet is maintained at 950° C. which equals about 0.8 the temperature of complete dissolution of the γ-phase, by cooling-down. At the same time the temperature of the other billet portion corresponding to the web and rim of the disk being produced and located in the high-temperature zone of the furnace of a disk-rolling device, is increased to the temperature not above 1.03 the temperature of complete dissolution of the γ-phase (1170+10° C.) for an hour. Establishing a variable temperature field in billet ranging from 0.8 the temperature of complete dissolution of the γ-phase in one billet portion to 1.03 the temperature of complete dissolution of the γ-phase in its other portion makes possible forming a microstructure with the grain size increasing steadily from 5.5 micron in the hub to 150 micron in the most heated billet portion corresponding to the web and rim of the disk being produced. On the other hand, a coarse-grained microstructure is established in the entire volume of the first billet, having the grain size of 165 micron. Subsequent cooling from the annealing temperature to the temperature of 950° C. is carried out at a variable rate ensuring a gain in the volume fraction of the γ-phase in the range of 26–17% per hour. As a result of heterogeneous annealing a coagulated γ-phase sized 0.3 to 0.4 micron precipitates uniformly inside the grains. Next a temperature of 1100° C. is set in the furnace and after heating the billets they are subjected to local shaping. Rolling is carried out under the temperature-rate conditions of superplasticity (1100° C., $\epsilon=10^{-2}-10^{-3}\ s^{-1}$) with a degree of deformation of 35–65%. First the hub is upset with a degree of 35%, then the hub-to-web billet transition area is rolled with a variable degree increasing to 55% in the web, wherein the degree of deformation ranges from 55 to 65%. Then the degree of deformation in the transition area from the web to the disk rim is gradually decreased to 40%.

After rolling the disks are oil quenched from the final strain temperature (1100+10° C.), and subjected to aging under the following conditions: holding at 850° C. for 6 hours, followed by air-cooling; holding at 800° C. for 16 hours, followed by air-cooling. Mechanical properties of the first disk in the respective zones are found to approximate those of the second disk specified in Table 1.

A specific feature of the second disk, as has been found by an analysis of its microstructure and mechanical properties, consists in that the structure states (FIG. 11) varying steadily from one disk portion to another are formed in the various disk zones (i.e., hub, web, and rim). Thus, the hub displays a fine-grained microstructure with the grain size of 35 micron, the web has a "necklace" microstructure, and the disk rim features a coarse-grained microstructure with serrated grain boundaries. This provides a steady variation of the short-time and high-temperature strength properties. The transient disk portions from the hub to the web and from the web to the rim exhibit the values of short-time strength at room temperature and long-term strength at an elevated temperature (650° C.) approximating the average characteristics observed in the adjacent disk portions (Table 1).

EXAMPLE 10

Fine-grained structure forged billets obtained under the conditions specified in Example 9 are rolled as follows. At the first stage the billets are subjected to working at 1075° C. to obtain an intermediate product having an outside diameter equal to 0.8 the final disk diameter. Then the temperature in the furnace of the disk-rolling device is increased to 1170° C. (that is, by 20° higher than the temperature of complete dissolution of the γ-phase) and the billets are held at that temperature for one hour. Next the billets are cooled at a variable rate providing a gain in the γ-phase changing within a range of 26–17% per hour, down to the deformation temperature. The working is performed concurrently with cooling from the annealing temperature downwards by reducing the strain rate to $10^{-4}\ s^{-1}$ at the beginning of the cooling procedure, followed by gradually increasing the strain rate to the preset value by the end of cooling.

The temperature of the hub is maintained below that of superplasticity throughout the working cycle. The rolling process is followed by heat-treatment of the disk by annealing directly from the deformation temperature with subsequent ageng. As a result of such heat-treatment a specified microstructure is formed in the disk, similar that described in Example 9 (that is, the microduplex one in the hub, the "necklace"-type in the web, and the coarse-grained microstructure with serrated grain boundaries in the rim).

Thus, the proposed method, in view of an inhomogeneous disk heating during operation, provides formation of a microstructure therein which varies in a predetermined way and ensures a change in the set of the disk mechanical properties adequate to the temperature field variation.

Industrial Applicability

The method described is intended for producing predominantly large critical parts of power plants and parts used in the aerospace engineering and fuel-and-power industries.

TABLE 1

| Example No | Disk portion where the specimen is cut from | T, ° C. | σ& MPa | $\sigma_{0.2}$ MPa | δ % | High-temperature strength at 650° C. $\sigma_0$, MPa | τ, hour |
|---|---|---|---|---|---|---|---|
| 2 | Hub | 20 | 1566 | 1220 | 16.4 | 1050 | 264 |
| | Web | 20 | 1562 | 1224 | 16.7 | 1050 | 280 |
| | Rim | 20 | 1560 | 1230 | 16.0 | 1050 | 296 |
| 9 | Hub | 20 | 1610 | 1180 | 17.2 | 1020 | 101 |
| | Web | 20 | 1590 | 1260 | 18.3 | 1050 | 276 |
| | Rim | 20 | 1560 | 1255 | 14.6 | 1100 | 296 |
| 9 | Hub-to-web transition area | 20 | 1570 | 1199 | 15.4 | 1050 | 270 |
| 9 | Web-to-rim transition area | 20 | 1538 | 1238 | 13.4 | 1080 | 179 |
| 10 | Hub | 20 | 1590 | 1173 | 16.3 | 1000 | 172 |
| | Web | 20 | 1581 | 1263 | 16.9 | 1050 | 250 |
| | Rim | 20 | 1540 | 1240 | 15.8 | 1080 | 115 |

T - test temperature,
σ& - test tensile strength of the material,
$\sigma_{0.2}$ - test tensile yield point,
δ - specimen percentage elongation at rupture,
σ - stress applied to specimen under temperature strength test

TABLE 2

| Alloy | State | T, ° C. | ϵ, $s^{-1}$ | $\sigma_{40}$, MPa | δ, % | m |
|---|---|---|---|---|---|---|
| ]3698 | K3 | 950 | $10^{-3}$ | 190 | 80 | 0.21 |
| | M3 | | | 120 | 320 | 0.4 |
| ]A962 | K3 | 1050 | $10^{-3}$ | 220 | 89 | 0.23 |
| | M3 | | | 40 | >500 | 0.6 |
| ]A975 | K3 | 1100 | $10^{-3}$ | 140 | 94 | 0.19 |
| | M3 | | | 20 | >550 | 0.8 |

K3 - coarse-grained state
M3 - post-TMP fine-grained state
ϵ - strain rate,
$\sigma_{40}$ - tensile test yield stress at 40% degree of deformation,
δ - specimen percentage elongation at rupture
m - coefficient of yield stress rate sensitivity

What is claimed is:

1. A method for producing axially symmetric parts from multiphase alloys comprising the steps of:

(a) shaping an axially symmetric billet of the part being produced by rolling the billet, while rotating about its own axis, with at least one roll which has at least three degrees of freedom, under controlled conditions for shaping the billet being processed, the conditions including strain-temperature-and-rate, the billet temperature, the load application pattern and the value of the load applied, the conditions determining the level of internal stresses in the billet and the level of the material strain resistance, at a billet temperature above 0.4 melting point of the multiphase alloy but below a temperature at which a total content of precipitates or an allotropic modification of a matrix of the multiphase alloy is not below about 7%, with a tool load of q of the roller, and meeting the following conditions:

$$\sigma_{SH}>q\geqq\sigma_{S\Delta}$$

$$K\cdot\sigma_{S\eta}>q$$

where:

$\sigma_{S\Delta}$ is the yield stress of the material of the billet portions subject to deformation;

$\sigma_{SH}$ is the strain resistance of the material of the billet portions not subject to deformation;

$K\leqq 2$, is an empirical coefficient; and $\sigma_{S\eta}$ is the strain resistance of the tool material at a strain temperature of the billet under process;

with the strain rate in the range from about $10^2$ to about $10^{-3}$ $s^{-1}$; and then heating the part to a temperature above or below a dissolution temperature of a second phase or allotropic modification depending on a microstructure of the material of the axially symmetric part resulting from the rolling procedure.

2. A method as set forth in claim 1, wherein rolling of the billet is preceded by a plastic deformation of a central portion of said billet by compressing with tail spindles which are then used for billet rotation.

3. A method as set forth in claim 1, wherein the billet is rolled by at least one pair of rolls, each roll in the pair exerting approximately the same force as the other roll of the pair.

4. A method as set forth in claim 3, wherein the load moments for each pair of rolls are mutually balanced in accordance with the following relationship:

$$q_i\cdot S_i\cdot L_i=q_{i+1}\cdot S_{i+1}\cdot L=1$$

where $q_i$ and $q_{i+1}$ are specific load of the rolls, $S_i$ and $S_{i=1}$ are billet-to-rolls contact are, $L_i$ and $L_{i=1}$ is the distance from the center of gravity of the contact are to the center of billet rotation, and i is 1, 2, 3, . . . number of rolls.

5. A method as set forth in claim 1, wherein rolling is accompanied by clockwise rotation of the billet and rolls at about equal speed.

6. A method as set forth in claim 1, wherein parts of a disk type are rolled by radially displacing the rolls forming the inner surface of the disk rim, relative to each other while retaining their mutual overlapping of the rolled area.

7. A method as set forth in claim 1, wherein parts of the disk type are rolled with at least three rolls of which two rolls form the inner disk surface, while the third roll forms the disk rim with a force not exceeding that exerted by the other two rolls.

8. A method as set forth in claim 1, wherein parts of as shell type are rolled with rolls spaced differently apart from the center of the billet rotation.

9. A method as set forth in claim 2, wherein parts of the shell type are rolled by displacing the tail spindles relative to the initial rolling plane.

10. A method as set forth in claim 1, wherein rolling is performed with an increased speed of radial roll displacement away from the disk axis.

11. A method as set forth in claim 1, wherein intricate-shaped parts are rolled with at least three rolls whose axis can rotate in the range of about 0 to 1 radian with respect to the axis of the billet rotation and make up an angle of about 0 to $2\pi$ radian with the axes of other rolls.

12. A method as set forth in claim 1, wherein the billet is rolled with rolls displaced with respect to the plane passing through the billet axis.

13. A method for producing axially symmetric parts from multiphase alloys, comprising the steps of:

(a) preparing the billet structure by a thermo-mechanical treatment, comprising heating the billet to a temperature at which a total content of precipitates or an allotropic modification of a matrix of the multiphase alloy exceeds about 7%, followed by a stage-by-stage reduction of the treatment temperature down to a temperature of formation of a stable fine-grained microstructure, the ratio between the grain sizes for different phases not exceeding 10;

(b) subjecting the billet to deformation as each decreasing temperature stage so as to reduce a billet cross-sectional area by about 1.2 to 3.9 times per stage;

(c) further subjecting the billet to deformation while rotating the billet around its own axis, by rolling it with at least one roll which has at least three degrees of freedom, under controlled conditions for shaping the billet being processed, the conditions including strain-temperature-and-rate, the billet temperature, the load application pattern and the value of the load applied, the conditions determining the level of internal stresses in the billet and the level of the material strain resistance, at a billet temperature above 0.4 melting point of the multiphase alloy but below a temperature at which a total content of precipitates or precipitated phases or an allotropic modification of the matrix of the multiphase alloy is not below 7%, with a tool load of q of the roller meeting the following conditions:

$$\sigma_{SH}>q\geqq\sigma_{S\Delta}$$

$$K\cdot\sigma_{S\eta}>q$$

where:

$\sigma_{SH}$ is the strain resistance of the material of the billet portions not subject to deformation;

$\sigma_{S\Delta}$ is the yield stress of the material of the billet portions subject to deformation;

$\sigma_{S\eta}$ is the strain resistance of the tool material at a strain temperature of the billet under process; and $K\leqq 2$, is an empirical coefficient;

with the strain rate in the range from about $10^2$ to about $10^{-3}s^{-1}$; and then (d) heating the part to a temperature above or below the dissolution temperature of the second phase or allotropic modification depending on a microstructure of the material of the axially symmetric part resulting from the rolling procedure.

14. A method as set forth in claim 13, wherein the billet is imparted, at step (a) of preparing the billet structure, the shape corresponding to that of the axisymmetrical part produced.

15. A method as set forth in claim 13, wherein a stage-by-stage reduction of the treatment temperature of the billet from nickel-based alloys is performed by providing a maximum increase in the amount of the γ-phase at each stage up to and including about 14%, and each stage of the thermo-mechanical treatment is followed by a post-deformation annealing at a temperature not exceeding the temperature of the beginning of deformation at a preceding stage of treatment.

16. A method as set forth in claim 13, wherein the strain rate at the first treatment stage ranges from about $10^2$ to about $10^{-3}$ $s^{-1}$, and the strain rate at the following stages is in accordance with the following relationship:

$$\epsilon_\eta=K_\phi\cdot\epsilon_{\eta\phi}\cdot T_\Delta/T_{\eta p\phi}$$

where $\epsilon_{\eta}$ is the strain rate at a next stage;

$\epsilon_{\eta p}$ is the strain rate a preceding stage;

$T_{\Delta}$ is a the deformation temperature;

$T_{\eta p \varphi}$ is the temperature of the second phase complete dissolution; and $K_{\varphi}$ is 2.

17. A method as set forth in claim 1, wherein the rolling of billets from age-hardenable alloys is preceded by annealing the billets in a monophase region at a temperature not exceeding 1.07 the temperature of the γ-phase complete dissolution, followed by cooling down to a temperature not above the rolling temperature at a cooling rate that ensures an increase in the amount of the γ-phase from 5% per hour to 50% per hour, and postrolling heat treatment of the part is carried out at a temperature of the γ-phase complete dissolution.

18. A method as set forth in claim 1, wherein the rolling procedure is preceded by annealing at least two billet portions so as to establish a temperature gradient, the temperature being changed in the range from about 0.8 the temperature of the γ-phase complete dissolution in one billet portion to a temperature not above 0.7 the temperature of the γ-phase complete dissolution in the other billet portion, followed by cooling down to a temperature not above the rolling temperature at a rate that ensures an increase in the amount of the γ-phase from 5% per hour to 50% per hour, and postrolling heat treatment of the part is carried out at a temperature below the temperature of the γ-phase complete dissolution.

19. A method as set forth in claim 1, wherein the rolling procedure is performed in two stages at the first of which the billet is subjected to deformation in a temperature range of superplasticity until the billet size gets equal to 0.6–0.9 of the part final size, after which the entire billet or its nonrolled portion is annealed in a monophase region, followed by cooling the billet from the annealing temperature down to a temperature not above the rolling temperature at a rate that increases an amount of the γ-phase form 5% per hour to 50% per hour, whereupon the billet is rolled to the part final size and heat-treated at a temperature below the temperature of the γ-phase complete dissolution.

20. A method as set forth in claim 1, wherein at least two adjacent billet portions are rolled at different deformation ratios that vary steadily from one billet portion to the another by 0.25 to 0.75 the deformation ratio of the adjacent billet portion.

21. A method as set forth in claim 13, wherein the thermo-mechanical treatment of the billet from age-hardenable alloys is followed, before the rolling procedure, by annealing the billet in a monophase region at a temperature not exceeding 1.07 the temperature of the γ-phase's complete dissolution, followed by cooling the billet from the annealing temperature down to the temperature not above the rolling temperature at a rate that ensures an increase in the amount of the γ-phase from 5% per hour to 50% per hour, and the postrolling billet heat-treatment is carried out at a temperature below the temperature of the γ-phase complete dissolution.

22. A method as set forth in claim 13, wherein the thermo-mechanical treatment of the billet from age-hardenable alloys is followed by annealing aimed at establishing a temperature gradient, the temperature being changed in the range from about 0.8 the temperature of the γ-phases complete dissolution in one billet portion to a temperature not above 1.07 the temperature of the γ-phase's complete dissolution in the other billet portion, followed by cooling down to a temperature not above the rolling temperature at a rate that ensures an increase in the amount of the γ-phase from 5% per hour to 50% per hour, and postrolling heat treatment of the part is carried out at a temperature below the temperature of the γ-phase complete dissolution.

23. A method as set forth in claim 13, wherein the thermo-mechanical treatment of the billet from age-hardenable alloys is followed by its rolling in two stages at the first of which the billet is subjected to deformation in a temperature range of susperplasticity until the billet size gets equal to about 0.6–0.9 of the part's final size, after which the entire billet or its nonrolled portion is annealed in a monophase region, followed by cooling the billet from the annealing temperature down to the temperature not above the rolling temperature at a rate that ensures an increase in the amount of the γ-phase from about 5% per hour to 50% per hour, whereupon the billet is rolled to the part's final size and heat-treated at a temperature below the temperature of the γ-phase complete dissolution.

24. A method as set forth in claim 13, wherein at least two adjacent billet portions are rolled at different ratios that vary steadily from one billet portion to the another by about 0.25 to 0.75 the deformation ratio of the adjacent billet portion.

* * * * *